US006623370B1

(12) United States Patent
Willer

(10) Patent No.: US 6,623,370 B1
(45) Date of Patent: Sep. 23, 2003

(54) GOLF TRAINING FACILITY

(76) Inventor: Rudolf H. Willer, 2617 Goddard Rd., Toledo, OH (US) 43606-3016

( * ) Notice: Subject to any disclaimer, the term of this patent is extended or adjusted under 35 U.S.C. 154(b) by 0 days.

(21) Appl. No.: 09/494,472

(22) Filed: Jan. 31, 2000

(51) Int. Cl.[7] ..... A63B 69/36

(52) U.S. Cl. ..... 473/169; 473/171; 473/185; 473/157

(58) Field of Search ..... 473/160, 161, 473/168–171, 181, 185, 157

(56) References Cited

U.S. PATENT DOCUMENTS

| | | | | | |
|---|---|---|---|---|---|
| 1,591,095 | A | | 7/1926 | Meyer | |
| D84,224 | S | | 5/1931 | Valvano | |
| 1,818,749 | A | | 8/1931 | Pittler | |
| 1,914,365 | A | * | 6/1933 | Ford | 273/118 R |
| 3,138,387 | A | | 6/1964 | Michel et al. | 273/176 |
| 3,522,947 | A | | 8/1970 | Anderson et al. | 273/176 |
| 3,862,760 | A | | 1/1975 | Davis | 273/176 |
| 3,885,795 | A | | 5/1975 | Brewer | 273/176 |
| 3,990,708 | A | * | 11/1976 | Ingwersen | 473/153 |
| 4,108,440 | A | | 8/1978 | Delaplaine | 273/176 |
| 4,114,887 | A | | 9/1978 | DelRaso | 273/176 |
| 4,225,136 | A | * | 9/1980 | Beam | 473/159 |
| 4,572,512 | A | | 2/1986 | Tegart | 273/176 |
| 4,743,026 | A | * | 5/1988 | Eady | 273/245 |
| 4,850,594 | A | | 7/1989 | Manzione | 273/176 |
| 4,988,105 | A | | 1/1991 | Perry et al. | 273/176 |
| 5,092,600 | A | | 3/1992 | Ruth, Jr. et al. | 273/176 |
| 5,112,054 | A | | 5/1992 | Oswald | 273/176 |
| 5,184,824 | A | | 2/1993 | Riedinger | 273/176 |
| 5,316,302 | A | * | 5/1994 | Sedberry | 273/108.21 |
| 5,390,926 | A | | 2/1995 | Hanson et al. | 273/176 |
| 5,419,561 | A | | 5/1995 | Weber | 273/176 |
| 5,496,033 | A | * | 3/1996 | Thompson | 47/17 |
| 6,196,929 | B1 | * | 3/2001 | Erodes et al. | 473/160 |

* cited by examiner

*Primary Examiner*—Mark S. Graham
(74) *Attorney, Agent, or Firm*—Brinks Hofer Gilson & Lione

(57) ABSTRACT

A chipping and putting golf training facility for practice, education, competition, and recreational use. The golf training facility is comprises a plurality of strip greens and fringe grass aprons specifically designed and arranged in an order to provide a systematic training method in chipping and putting. Each strip green of the plurality exposes the golf trainee to a different putting circumstance naturally encountered in chipping and putting on a golf course. Each strip green is essentially planar and has an uphill or downhill longitudinal inclination and a left to right or right to left transverse downhill inclination. The preferred embodiment utilizes a combination of small, medium, and large inclinations along both axes. The preferred embodiment also includes two strip greens with level upper and lower tiers and an inclined planar surface separating the two level tiers.

16 Claims, 6 Drawing Sheets

GOLF TRAINING FACILITY

BACKGROUND OF THE INVENTION

The invention relates generally to a golf training facility and more particularly to a golf chipping and putting training facility.

There are currently about 26 million golfers in the United States. Of these 26 million, a large percentage seek to improve his or her game. Accordingly, an increasing amount of time and money is spent on training and recreational activities. Up to now, most training activities are directed toward ball striking ability at conventional driving ranges. Although commercial putting facilities are available, they have been limited to recreational interests, such as miniature golf. There remains a need to provide a serious, structured training facility directed to the improvement of chipping and putting skills.

A high percentage of the strokes taken in the average golfer's game are putts. For example, putting may account for up to 50 percent of the actual strokes taken during each round of golf. Chipping onto the putting green also accounts for a significant number of strokes. For these reasons, teaching professionals recommend that a greater percentage of the practice time be directed to activities on or around the putting green.

It remains that the training facilities directed to golf's short game are inadequate. Typical practice greens, found at driving ranges, are normally not well maintained. Further, they provide no systematic, progressive training method and means of progress measurement. Similarly, practice greens located at golf courses incorporate no systematic training method or means for measuring progress and often prohibit chipping golf balls onto the green.

While facilities dedicated to putting exist, these miniature golf facilities are more directed toward recreation than training in real golf. Miniature golf facilities typically utilize carpeted putting surfaces that do not produce a realistic speed and roll of the golf ball. Additionally, these facilities often include artificial obstacles such as windmills and clowns that are rarely seen on an actual golf courses. Miniature golf facilities cater to the novice or non-golfer. They provide recreational competition but are generally avoided by the serious golfer.

Traditional golf courses also have limitations. Many 30 to 50 year old serious golfers do not always have the 4 to 5 hours required for a round of traditional golf.

This invention provides an alternative for serious golfers who desire real golf competition and training in chipping and putting within a shortened period of time.

Prior inventions in this field do not address the limitations noted. U.S. Pat. No. 4,225,136 teaches a golf course laid out in strips but is directed toward approach shots to the green, rather than focusing on chipping and putting. Further, it suggests no systematic training pattern in its design. U.S. Pat. Nos. 3,522,947, 3,867,760 and 5,390,926 disclose individual practice golf greens but are not directed to the concept of a training facility and further teach no systematic training pattern. Finally, U.S. Pat. No. 5,184,824 discloses a golf training facility that emphasizes approach shots and traditional putting greens but again does not address a systematic training method for chipping and putting.

SUMMARY OF THE INVENTION

A golf training facility for practice in chipping and putting, education, competition, and recreational use. The golf training facility comprises a plurality of strip greens specifically designed and arranged in order to provide a systematic training method. Each strip green of the plurality exposes the golf trainee to a unique putting circumstance naturally encountered on a golf course. Each strip green is essentially planar and has an uphill or downhill longitudinal inclination and a left to right or right to left transverse downhill inclination. The preferred embodiment utilizes a combination of small, medium, and large inclinations along both axes. The preferred embodiment also includes two strip greens with level upper and lower tiers and an inclined planar surface separating the two tiers. In the preferred embodiment, each putting surface is unique within the training facility.

A first alternate embodiment of the invention focuses on uphill putts of two inclinations before focusing on downhill putts of two inclinations while alternating left to right and right to left transverse downhill inclinations. A second alternate embodiment of the invention focuses on left to right and right to left breaking putts while adding little in the way of longitudinal inclination. A third alternate embodiment adds chance to the difficulty of each strip green by locating the tee area within a grid defined on each strip green, wherein the tee location is determined by a random position generation means and is called "Luck of the Roll". The third alternate embodiment also combines the planar strip greens of the initial embodiments with a plurality of chipping or pitching aprons disposed about the periphery of the strip greens. Either the strip greens and grid or the plurality of chipping aprons may be utilized separately with the "Luck of the Roll" chance placement means.

The invention resides not in any one of these strip greens, per se, but rather in a combination of them as herein disclosed and claimed. The golf training facility is distinguished from the prior art in that this combination of strip greens provides a structured training method rather than random practice. Such chipping and putting when learned will result in more pars and birdies and thus result in lower golf scores.

It is therefore an object of the present invention to provide a golf training facility for structured, systematic training of golf chipping and putting skills.

It is a further object of the present invention to provide a golf training facility for recreation and competition.

It is a still further object of the present invention to provide a golf training facility for systematic, structured enhancement of chipping and putting skills.

It is a still further object of the present invention to provide a golf training facility wherein the difficulty of each strip green and chipping apron is determined by chance.

It is a still further object of the present invention to provide a golf training facility for allowing 18 holes of the major part of golf (i.e. chipping and putting) to be played in a greatly reduced period of time.

It is a still further object of the present invention to provide a golf training facility with natural turf such that it replicates the actual conditions on a golf course green.

It is a still further object of the present invention to provide a golf training facility with an artificial turf putting surface that may be installed within a structure as well as outdoors.

It is a still further object of the present invention to provide a golf training facility wherein the putting surface of each strip green is essentially planar; the putts "break" is easily predictable and the trainee's practice time is well spent.

Further objects and advantages of the present invention will become apparent by reference to the following description of the preferred embodiment, the alternate embodiments, and the appended drawings wherein like reference numbers refer to the same component, element or feature.

BRIEF DESCRIPTION OF THE DRAWINGS

The above-mentioned features of the invention will become more clearly understood from the following detailed description of the invention read together with the drawings in which.

DESCRIPTION OF THE PREFERRED AND ALTERNATE EMBODIMENTS

Figure 1:
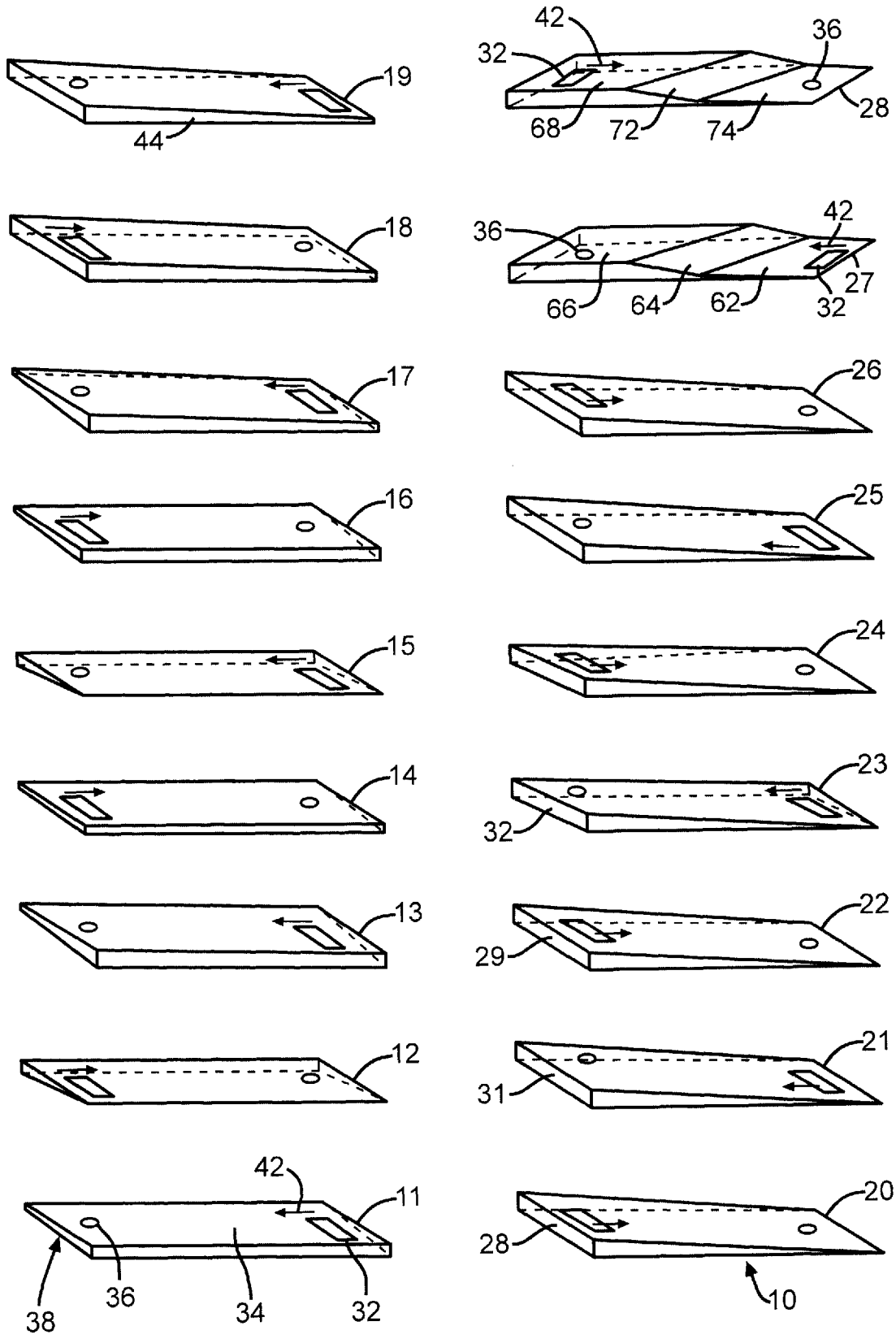
FIG. 1 is a combined perspective view of the golf training facility constructed in accordance with the present invention, presenting each strip green with its distinguishing features identified.

Referring to FIG. 1, a golf training facility 10 incorporating the present invention is illustrated. The golf training facility 10 includes a plurality of individual distinct strip greens 11 through 28 arranged in close proximity and utilized in sequence to focus on specific putting circumstances encountered on a typical putting green.

The golf training facility 10 is comprised of eighteen individual strip greens 11 through 28. The strip greens 11 through 26 each have common structural elements. The strip greens 27 and 28 combine certain structural elements. These common structural elements are identified in strip greens 11 and 19. The strip green 11 has a tee area 32, a planar putting surface 34, a cylindrical hole 36, a transverse inclination 38, and a direction of play 42. The strip green 19 of FIG. 1 further includes a longitudinal inclination 44. The strip green 11 has no longitudinal inclination, merely a transverse inclination 38. Alternatively, the strip green 19 has a longitudinal inclination 44 but no transverse inclination. The strip greens 11 through 26 comprise a combination of inclinations, both transverse and longitudinal, to produce unique individual putting conditions on each strip green. In the preferred embodiment, shown as Table 1, the strip greens 11 through 26 show three different longitudinal inclinations and three different transverse inclinations. In general, these inclinations may be considered small, medium, and large. The angular inclinations indicated in Tables 1 through 3 are preferred for a particular green speed, or rolling resistance. They are exemplary only and are not intended to limit the invention to such angles.

Figure 2:
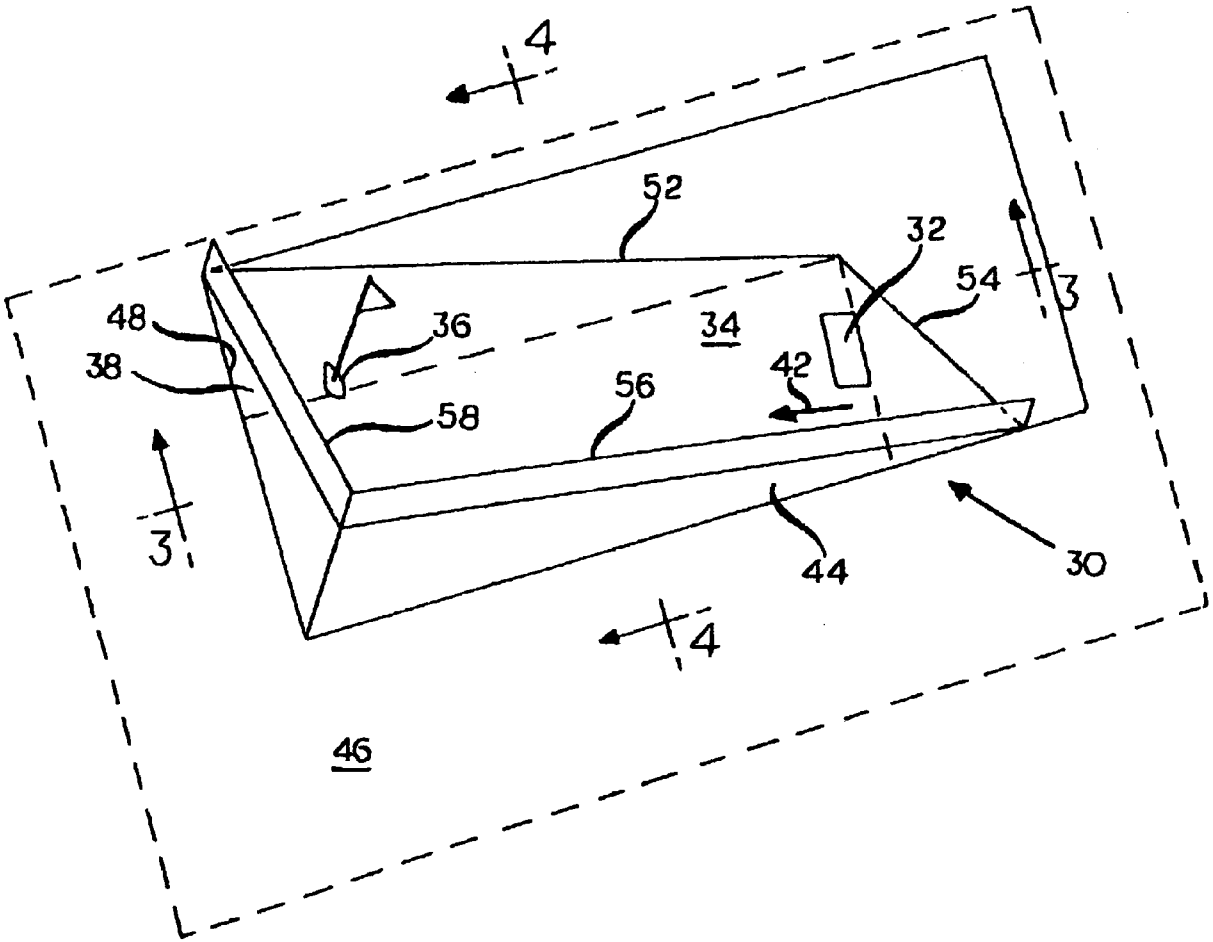
FIG. 2 is a perspective view of an individual strip green wherein the distinguishing features of an individual strip green are shown.

Referring to FIG. 2, an individual strip green 30 with both longitudinal and transverse inclinations is shown in perspective. This individual strip green 30 is shown displaced from a ground level planar surface 46. Clearly shown in FIG. 2 is the tee area 32, the planar putting surface 34, the cylindrical hole 36, the direction of play 42, the transverse inclination 38, and the longitudinal inclination 44. The planar putting surface 34 is created when a surface initially disposed along the plane defined by the ground level planar surface 46 is inclined along the direction of play 42 as shown by the longitudinal inclination 44 and inclined across the direction of play 42 as shown by the transverse inclination 38. The resulting planar putting surface 34 is ideally a rectangular surface displaced from the ground level planar surface 46. However, when a golf ball struck in the direction of play 42 does not enter the cylindrical hole 36 and has sufficient momentum to carry it downward across the planar putting surface 34, a purely rectangular configuration of the putting surface 34 would produce a vertical drop at a location 48 due to the longitudinal inclination 44. This vertical drop at location 48 would prevent a trainee golfer from making a second putt to reach cylindrical hole 36. Accordingly, the planar putting surface 34 may be extended beyond rectangular to intersect the ground level planar surface 46 at a lateral edge 52. Likewise, regarding longitudinal inclination 44, an end edge surface 54 of planar putting surface 34 extends to intersect the ground level planar surface 46. Bordering the lateral edge of the planar putting surface 34 at the top of the transverse inclination 38 is a side fence 56. This side fence 56 of approximately six inches (15.2 cm.), extends directly away from ground level planar surface 46 to provide a barrier over which a golf ball, when putted, cannot pass through. Similarly, at the terminal end of the planar putting surface 34, adjacent the cylindrical hole 36, is an end fence 58. The end fence 58 is also approximately six inches high (15.2 cm.) and provides a backstop for a golf ball when putted from the tee area 32.

Figure 3:
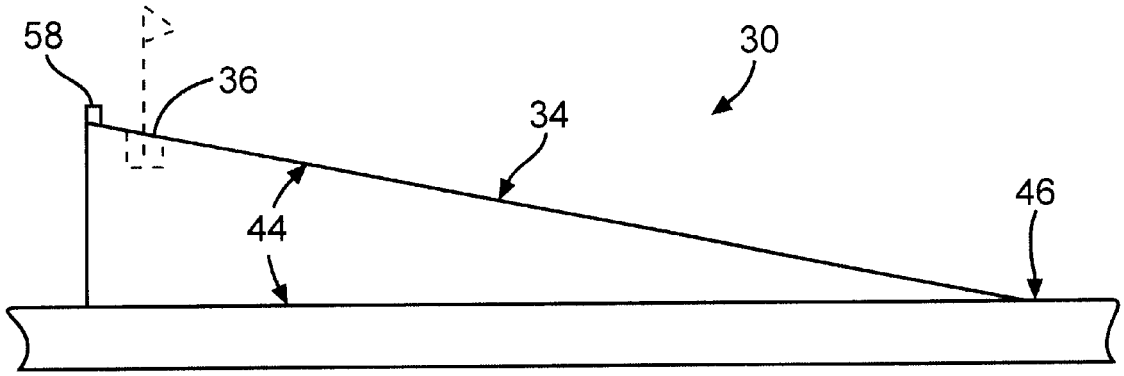
FIG. 3 is a full sectional view of an individual strip green taken along lines 3—3 of FIG. 2.
Figure 4:
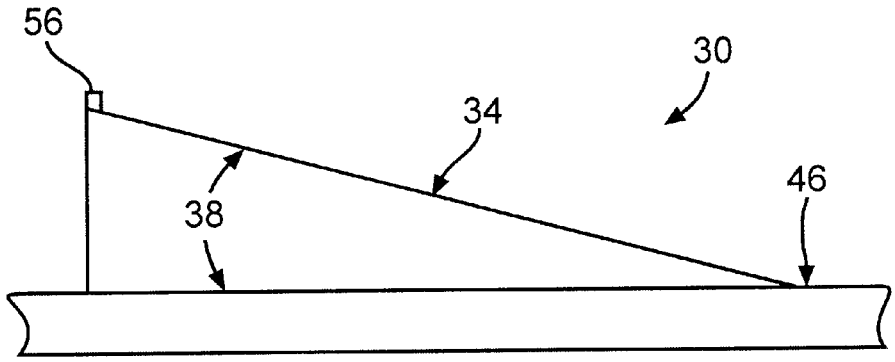
FIG. 4 is a full sectional view of an individual strip green taken along lines 4—4 of FIG. 2.

Further shown in FIG. 2 are two pairs of section lines. FIG. 3 is a section view taken longitudinally along 3—3. FIG. 4 is a section view taken transversely across 4—4.

Referring to FIG. 3, the individual strip green 30 of FIG. 2 is shown in longitudinal cross section taken at section lines 3—3. Forming the lower horizontal plane is the ground level planar surface 46. Extending upward along the longitudinal inclination 44 is the planar putting surface 34. Located adjacent the cylindrical hole 36 is the end fence 58.

Referring to FIG. 4, the same individual strip green 30 from FIG. 2 is shown in transverse cross section taken at section lines 4—4. The planar putting surface 34 extends away from the ground level planar surface 46 along the transverse inclination 38. Bordering the upper edge of planar putting surface 34 is the side fence 56.

Referring to FIG. 1, there are two additional strip greens 27 and 28, with several different characteristics to the strip greens 11 through 26. Referring specifically to a strip green 27, the tee area 32, the cylindrical hole 36, and the direction of play 42 are similar in all respects to those which are shown in the strip green 11. The strip green 27, however, has three planar surfaces 62, 64, and 66, rather than the single planar putting surface 34 of the strip green 11. A lower tier surface 62 is coplanar with the ground level planar surface 46. The lower tier surface 62 has no inclination. Likewise, an upper tier surface 66 is displaced a distance from the ground level planar surface 46 and has no inclination. Disposed on the lower tier surface 62 is the tee area 32. Disposed upon the upper tier surface 6 6 is the cylindrical hole 36. The direction of play 42 on the strip green 27 requires the ball to move from the lower tier surface 62 to the upper tier surface 66, forcing it to traverse an inclined planar surface 64. The inclined planar surface 64 may be inclined transversely across the direction of play 42 and also longitudinally into the direction of play 42, or some combination thereof. The degree of inclination of the inclined planar surface 64 is based on naturally occurring elevations in a typical golf course green.

Referring to a strip green 28, an inverse of the strip green 27 is shown. The tee area 32 is now disposed on an upper tier surface 68. The cylindrical hole 36 is now disposed on a lower tier surface 74 which is coplanar with the planar surface 46. Both the upper tier surface 68 and the lower tier surface 74 are parallel, disposed a short distance from each other, and are connected by an inclined planar surface 72. On the strip green 28, a golf ball is struck from the tee area 32 on the upper tier surface 68 along the direction of play 42, across the adjacent inclined planar surface 72, down to the adjacent lower tier surface 74. The inclined planar surface 72 may have a transverse inclination or a longitudinal inclination, or a combination thereof. The total inclination of the inclined planar surface 72 is not to exceed that which is naturally found on a typical golf course green.

As shown in FIG. 1, the golf training facility 10 is comprised of a plurality of individual and unique strip greens. The combination of these strip greens is not random as found in many existing training facilities or on a practice putting green of a golf course. The present invention is directed to a unique combination and pattern of strip greens such that the golf trainee may systematically master the increasingly difficult putting circumstances he will encounter on a golf course. With this in mind, Table 1 shows the preferred embodiment of the golf training facility and the combinations of inclinations and putting difficulty that would be encountered when following this systematic training method. Table 1 shows the strip greens 11 through 28 and the longitudinal and transverse inclinations incorporated therein.

For example, the strip green number 11 has a longitudinal inclination 44 of zero degrees and a small transverse inclination 38 of approximately one to five degrees. This corresponds to a low difficulty putting green. Whereas, the strip green 12 has a longitudinal inclination 44 of zero degrees and a transverse inclination 38 of three to eight degrees. This medium inclination would give the strip green 12 a greater level of difficulty than the strip green 11. The strip green 13 also has a longitudinal inclination 44 of zero degrees but has a larger transverse inclination 38 of five to ten degrees. This produces an even higher difficulty putting green. The strip green 14, having a negative one to five degrees transverse inclination 38 indicates that it is sloped downward from right to left rather than being sloped upward from right to left as is shown in FIG. 4.

The strip greens 15 and 16 increase their right to left inclination to a medium three to eight degrees, and a maximum, five to ten degrees respectively. The strip green 17 increases the difficulty by combining an uphill longitudinal inclination 44 of one to five degrees with a transverse inclination 38 of one to five degrees. This produces an uphill, slightly right to left putt. The strip green 18 is the reverse of strip green 17 in that it has a downhill longitudinal inclination 44 of one to five degrees and a right to left downhill transverse inclination 38 of one to five degrees. The strip green 19 follows with a medium longitudinal inclination 44 of three to eight degrees uphill. The strip green 20 is similar to the strip green 19 but has a longitudinal inclination 44 of minus three to eight degrees giving it a downhill slope. Correspondingly, the strip greens 21 and 22 alternate large, five to ten degree uphill and downhill longitudinal inclinations 44.

The strip green 23 combines a medium longitudinal inclination 44 of three to eight degrees with a medium transverse inclination 38 of negative three to eight degrees. Again, a negative inclination means a right to left downward inclination. The strip green 24 combines a downhill longitudinal inclination 44 of negative five to ten degrees with a left to right transverse inclination 38 of one to five degrees. The strip green 25 is the inverse of the strip green 24 making these two strip greens the most difficult of the golf training facility 10. The strip green 26 is the inverse of strip green 23 with a downhill longitudinal inclination 44 of negative three to eight degrees and a left to right transverse inclination 38 of three to eight degrees.

The strip greens 27 and 28 are two tiered strip greens as previously described. The strip green 27 is an uphill, two tier configuration where the ball is struck from the tee area 32 on the lower tier surface 62, up the inclined plane 64, to the upper tier surface 66. The elevation of the upper tier 66 over the lower tier 62 is approximately six to twelve inches (15.2 to 30.5 cm.) as shown on Table 1. The inclination, and therefore the length of the inclined plane 64, preferably does not exceed that which may be found on a typical golf course green. The final strip green 28 is a two tiered combination where the putt is struck on the upper tier surface 68, traverses the inclined planar surface 72, down to the lower tier surface 74. The upper tier surface 68 is disposed approximately six to twelve inches (15.2 to 30.5 cm.) above the lower tier surface 74 as indicated as a negative number on Table 1. Again, the inclination of the inclined planar surface 72 is not to exceed that which may be found on a typical golf course.

This combination of strip greens from 11 through 28 comprise a complete golf training facility 10 that includes a structured and sequenced pattern of training.

TABLE 1

GOLF TRAINING FACILITY 10
PREFERRED EMBODIMENT

| STRIP GREEN | LONGITUDINAL INCLINATION 44 (DEGREES) | TRANSVERSE INCLINATION 38 (DEGREES) |
|---|---|---|
| 11 | 0 | 1 to 5 |
| 12 | 0 | 3 to 8 |
| 13 | 0 | 5 to 10 |
| 14 | 0 | −1 to −5 |
| 15 | 0 | −3 to −8 |
| 16 | 0 | −5 to −10 |
| 17 | 1 to 5 | 1 to 5 |
| 18 | −1 to −5 | −1 to −5 |
| 19 | 3 to 8 | 0 |
| 20 | −3 to −8 | 0 |
| 21 | 5 to 10 | 0 |
| 22 | −5 to −10 | 0 |
| 23 | 3 to 8 | −3 to −8 |
| 24 | −5 to −10 | 1 to 5 |
| 25 | 5 to 10 | −1 to −5 |
| 26 | −3 to −8 | 3 to 8 |

| STRIP GREEN | UPPER TIER ELEVATION (INCHES) | INCLINED PLANE LONGITUDINAL AND TRANSVERSE INCLINATION |
|---|---|---|
| 27 | 6 to 12 | Not to exceed that which may be found on typical golf course |
| 28 | −6 to −12 | |

It is readily apparent that the present invention is not to be limited to a particular combination of strip greens. For example, a first alternate embodiment of a golf training facility 10' is summarized in Table 2. Table 2 comprises a combination including two different longitudinal inclinations 44' with two different transverse inclinations 38'. Taking two left to right transverse inclinations, two right to left transverse inclinations, two upward longitudinal inclinations, and two downward longitudinal inclinations, a combination of sixteen strip greens 11 through 26 is assembled. In addition to these sixteen strip greens, two additional strip greens 27 and 28 with zero longitudinal inclination, each having medium transverse inclinations of left to right and right to left, complete the eighteen strip greens recommended for a complete golf training facility.

In Table 2, the strip greens are numbered from 11 through 28. The first four strip greens 11 through 14 are uphill with longitudinal inclinations 44 of one to five degrees. Their transverse inclinations 38 alternate first left to right of one to five degrees then three to eight degrees and right to left one to five degrees and three to eight degrees. As the longitudinal inclination 44 varies only after four consecutive strip greens, the transverse inclination 38 varies from each strip green to the next. Alternatively for proper training, the transverse inclination could be held constant for four strip greens, and the longitudinal inclination 44 could vary with each consecutive strip green.

TABLE 2

GOLF TRAINING FACILITY 10'
FIRST ALTERNATE EMBODIMENT

| STRIP GREEN | LONGITUDINAL INCLINATION 44 (DEGREES) | TRANSVERSE INCLINATION 38 (DEGREES) |
|---|---|---|
| 11 | 1 to 5 | 1 to 5 |
| 12 | 1 to 5 | 3 to 8 |
| 13 | 1 to 5 | −1 to −5 |
| 14 | 1 to 5 | −3 to −8 |
| 15 | 3 to 8 | 1 to 5 |
| 16 | 3 to 8 | 3 to 8 |
| 17 | 3 to 8 | −1 to −5 |
| 18 | 3 to 8 | −3 to −8 |
| 19 | −1 to −5 | 1 to 5 |
| 20 | −1 to −5 | 3 to 8 |
| 21 | −1 to −5 | −1 to −5 |
| 22 | −1 to −5 | −3 to −8 |
| 23 | −3 to −8 | 1 to 5 |
| 24 | −3 to −8 | 3 to 8 |
| 25 | −3 to −8 | −1 to −5 |
| 26 | −3 to −8 | −1 to −5 |
| 27 | 0 | 3 to 8 |
| 28 | 0 | −3 to −8 |

Referring to Table 3, a second alternate embodiment of a golf training facility 10" is shown. In the second alternate embodiment, the training facilty 10" is more focused on transverse inclination 38 than uphill or downhill longitudinal inclination 44. In the golf training facility 10", strip greens 11 through 28 comprise zero longitudinal inclination for six strip greens, a slight upward inclination for six strip greens and a slight downward inclination for six strip greens. The focus, however, is on transverse inclination 38; the first three strip greens 11 through 13 have increasing left to right transverse inclinations. The next three strip greens 14 through 16 have increasing right to left transverse inclinations. This same systematic pattern of training is repeated for the slight uphill longitudinal inclination 44 of strip greens 17 through 22 and for the slight downward longitudinal inclination 44 of strip greens 23 through 28.

TABLE 3

GOLF TRAINING FACILITY 10"
SECOND ALTERNATIVE EMBODIMENT

| STRIP GREEN | LONGITUDINAL INCLINATION 44 (DEGREES) | TRANSVERSE INCLINATION 38 (DEGREES) |
|---|---|---|
| 11 | 0 | 1 to 5 |
| 12 | 0 | 3 to 8 |
| 13 | 0 | 5 to 10 |
| 14 | 0 | −1 to −5 |
| 15 | 0 | −3 to −8 |
| 16 | 0 | −5 to −10 |
| 17 | 1 to 5 | 1 to 5 |
| 18 | 1 to 5 | 3 to 8 |
| 19 | 1 to 5 | 5 to 10 |
| 20 | 1 to 5 | −1 to −5 |
| 21 | 1 to 5 | −3 to −8 |
| 22 | 1 to 5 | −5 to −10 |
| 23 | −1 to −5 | 1 to 5 |
| 24 | −1 to −5 | 3 to 8 |
| 25 | −1 to −5 | 5 to 10 |
| 26 | −1 to −5 | −1 to −5 |
| 27 | −1 to −5 | −3 to −8 |
| 28 | −1 to −5 | −5 to −10 |

Figure 5:
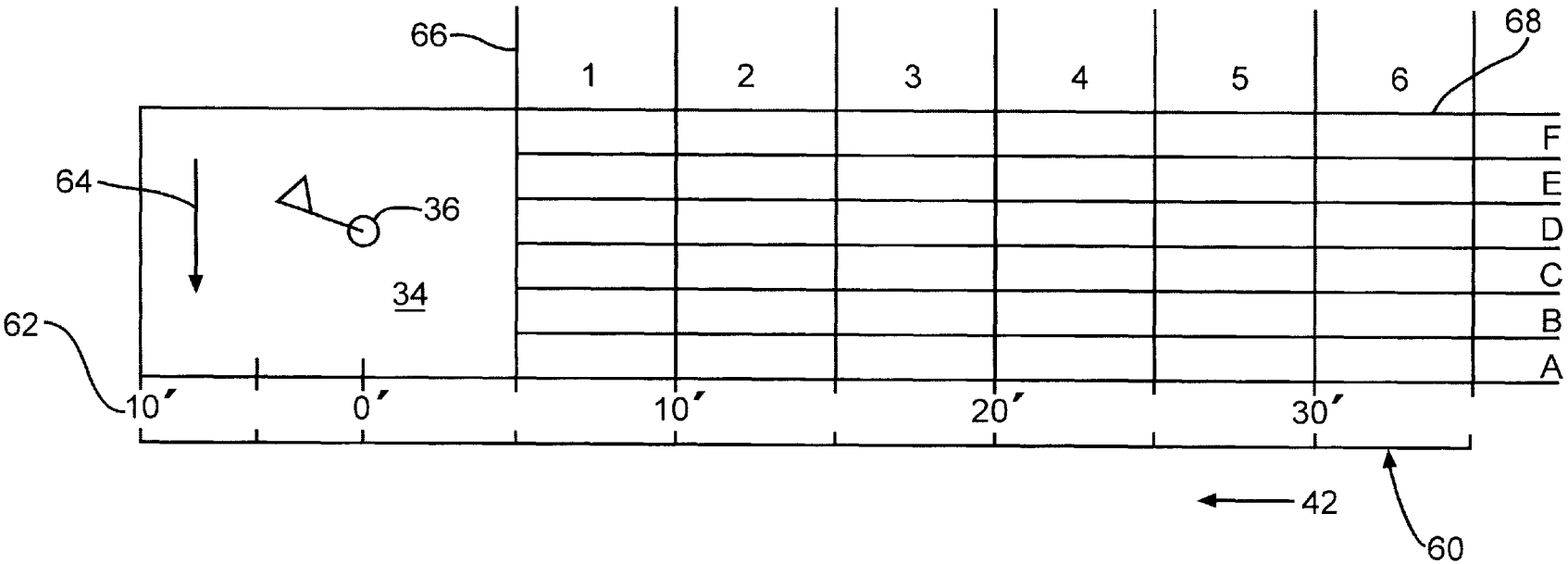
FIG. 5 is a plan view of an inner (putting) strip green of a third alternate embodiment of the invention including a grid for locating the tee position by chance.
Figure 6:
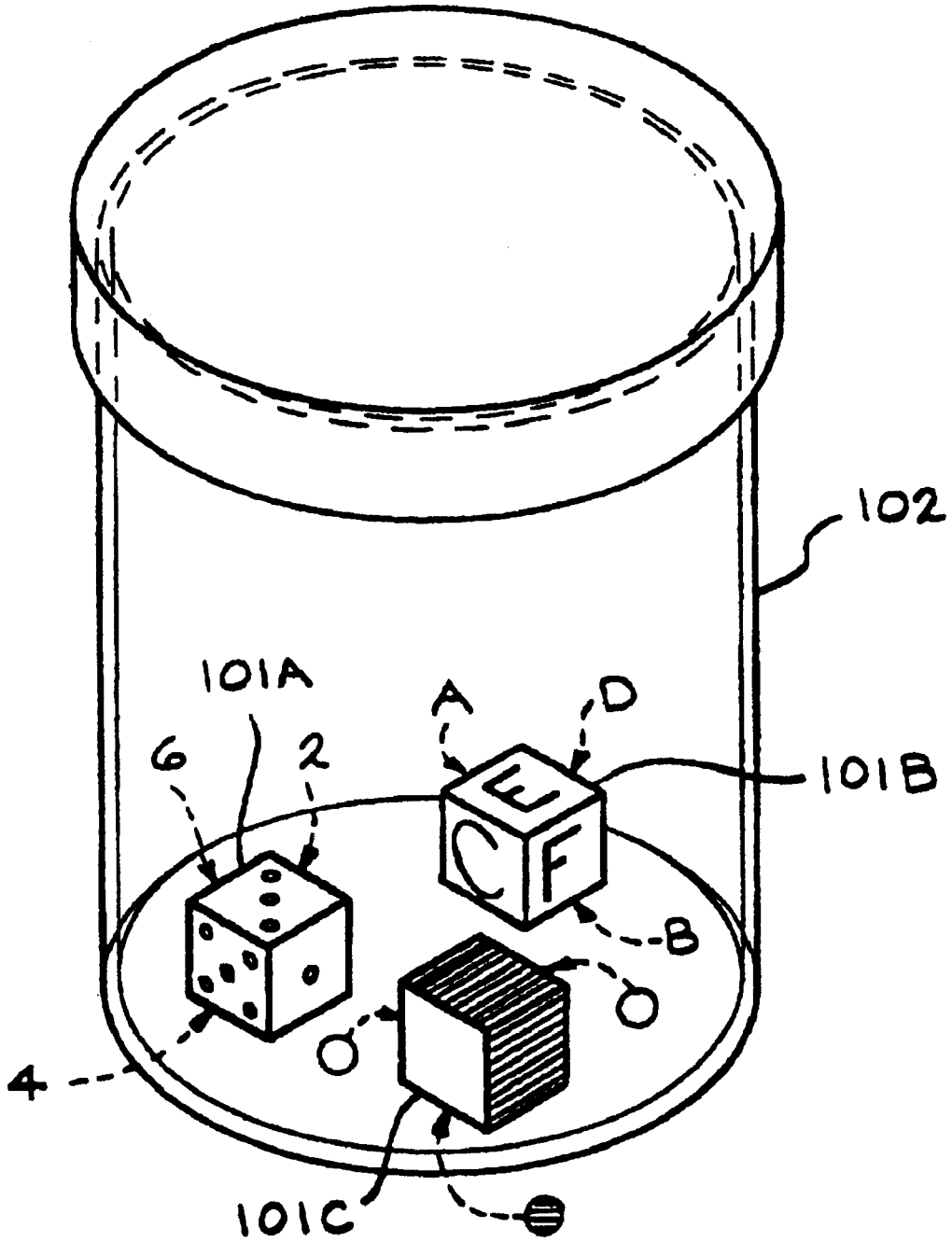
FIG. 6 is a random position generator utilized with the third alternate embodiment which comprises a container and specially configured dice.
Figure 7:
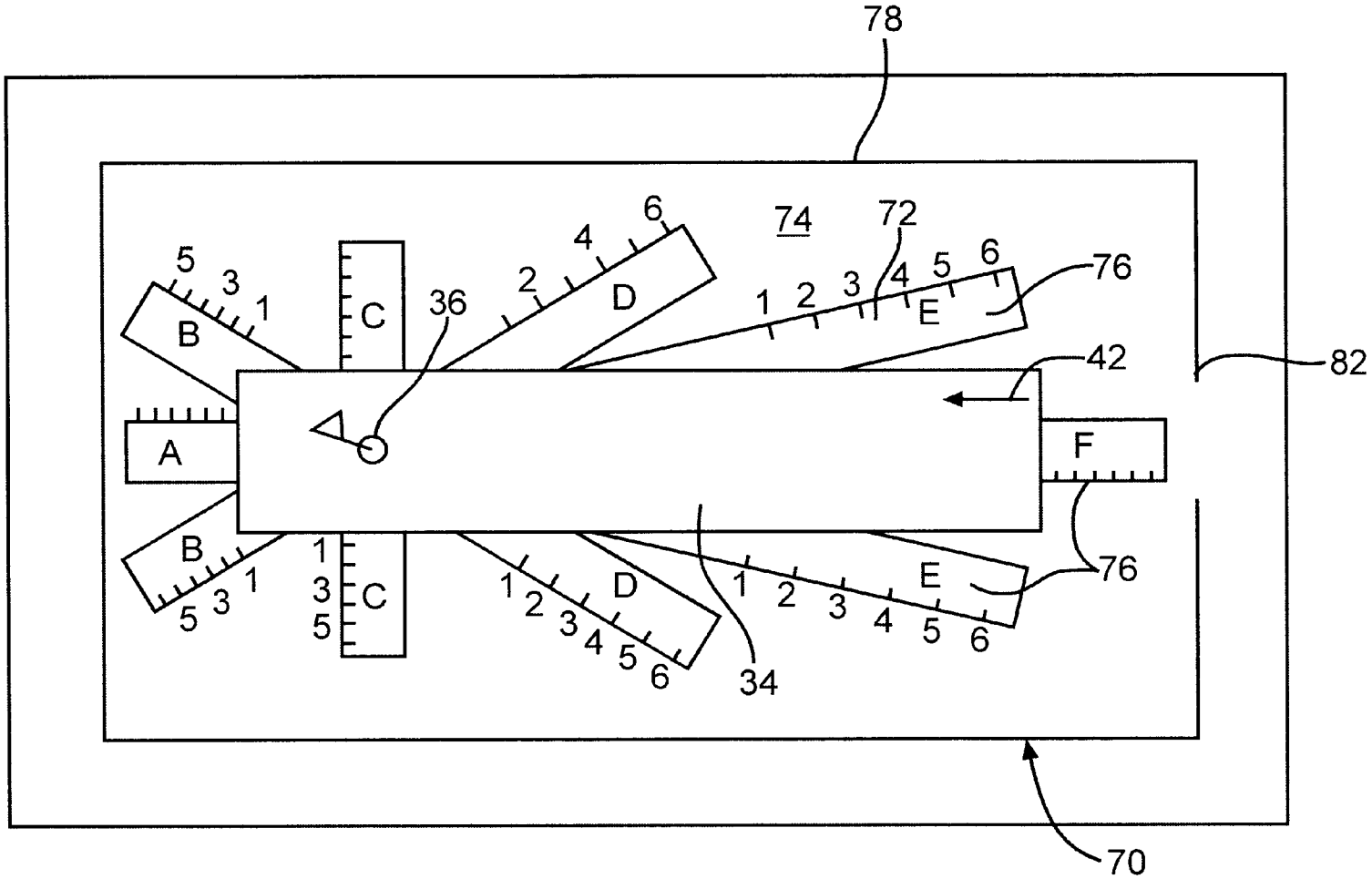
FIG. 7 is a plan view of an outer (chipping) strip green of the third alternate embodiment of the invention wherein a plurality of outer aprons surround the inner strip green and the tee position is also located by chance.

In the third alternate embodiment of the present invention as illustrated in FIGS. 5, 6 and 7, an individual strip green 60 is shown with several distinctive additional features. The individual strip green 60 is shown in plan view as an elongate rectangle very similar to the strip green 30 as shown in FIG. 2. The strip green 60 is similar to the hereinbefore described strip green 30 with respect to the planar putting surface 34, the cylindrical hole 36, the direction of play 42, the transverse inclination 38, the longitudinal inclination 44, and the side and end fences 56 and 58. The primary differences of the strip green 60 are the addition of a distance scale 62 and a grid scheme comprising a longitudinal grid 66 and a lateral grid 68. The distance scale 62 is located adjacent the planar putting surface 34 and is measured in five foot (1.52 m.) increments. An exemplary strip green would be approximately 45 feet (13.7 m.) in length. The distance scale 62 would be marked at zero feet adjacent the cylindrical hole 36 and would increase away from the cylindrical hole 36 ten feet (3.05 m.) regardless of the direction.

A second major addition to the third alternate embodiment depicted in FIG. 5 is the grid scheme comprising longitudinal spaces 66 and lateral spaces 68. The longitudinal spaces 66 include six strips designated by numbers 1 through 6 and the lateral spaces 68 include six strips designated by letters A through F. Each of the thirty-six regions of the strip green 60 is thus identified by a unique combination of one number and one letter. The higher the number, the greater the relative difficulty of the placement of the ball in the strip green 60. For example, a tee placement at grid location 6 along the longitudinal spaces 66 would be a more difficult tee placement than one located at grid location 1. Correspondingly, a direction of inclination 64 defines the downward slope of the transverse inclination 38. In other words, the direction of inclination 64 indicates which way a golf ball would break when putted along direction of play 42. Relating this to the grid scheme, a tee area placed at position F along the lateral spaces 68 would produce a more difficult putt than a tee area placed at position A along the lateral spaces 68.

Referring now to FIG. 6, to determine the tee position on each strip green 60 according to the longitudinal spaces 66 and the lateral spaces 68, the numbers between 1 and 6 and the letters between A and F are generated randomly by at least a pair of dice 101 A and 101 B disposed in a preferably closed container 102, a computer, or by any other commonly known means for generating numbers and letters. It will be appreciated that the grid scheme defined by the longitudinal spaces 66 and the lateral spaces 68 is not limited to six positions. Any number of positions that may be physically accommodated on the strip green 60 may be selected. As illustrated in FIG. 6, such random position generation may be achieved by, for example, the die 101A having sides designated 1 through 6, the die 101B having sides designated A through F and a third specially configured die 101C having three green sides and three black sides. Other colors or designations such as G for green and R for rough (or C for chip), for example, may be utilized, the important feature being a die 101C having two states or conditions of equal probability.

In the second portion of the third alternate embodiment of the present invention shown in FIG. 7, an individual strip green 70. The strip green 70 is similar to the hereinbefore described strip green 30 with respect to the planar putting surface 34, the cylindrical hole 36, the direction of play 42, the transverse inclination 38, the longitudinal inclination 44, and the respective end and side fences 58 and 56. In addition to these structural features, the strip green 70 incorporates a plurality of chipping aprons 72 which are located on a chipping perimeter surface 74. The chipping aprons 72 have a greater length of turf grass to allow a practicing golfer to chip or pitch his or her golf ball onto the planar putting surface 34 toward the cylindrical hole 36. The strip green 70 may have a plurality of chipping aprons 72 as shown in FIG. 7 or may include the entire chipping surface within the perimeter surface 74 for chipping at any point thereupon. Located on each of the plurality of chipping aprons 72 are tee areas 76. Each chipping apron 72 has its own tee area 76 and these tee areas 76 may be numbered one through six as shown in FIG. 7 or lettered A through F, to determine the tee location at each strip green 70 by a random number generator such as the dice 101A and 101B as previously described. The third die 101C, of course, is utilized to determine whether the golfer starts on and utilizes the (putting) strip green 60 illustrated in FIG. 5 or the (chipping) strip green 70 illustrated in FIG. 7. Defining the periphery of the perimeter surface 74 is a chipping perimeter fence 78. The chipping perimeter fence 78 is to be tall enough to prevent a golf ball from exiting the area defined by the chipping perimeter surface 74. This height may range from 1 to 12 feet (0.3 to 3.66 m.) depending on the skill of the golfer and liability concerns for the golf training facility. The practicing golfer would enter the strip green 70 at an entrance 82 located adjacent the terminal end of the strip green nearest the tee area 76.

It will be appreciated that the golf training facilities described herein may be comprised of a variety of conventional construction materials and may take a variety of configurations. A typical facility would use natural grass turf and would be located outdoors. As the putting surface grass length dictates the speed of a putt, different grass lengths can yield a different difficulty of the golf training facility. A tall grass would yield a slow putt whereas a medium or short grass would yield a very fast putt. A typical strip green would be approximately 40 feet (12.2 m.) in length and 8 feet (2.44 m.) in width provided that a chipping apron is not attached thereto. With a lateral spacing of 4 feet (1.22 m.) between strip greens an eighteen strip green facility would require roughly 50 by 228 feet (15.24 by 69.5 m.). Additionally, the third alternate embodiment as shown in FIG. 7 with chipping aprons would require an elongate area approximately 28 feet (8.53 m.) in width and 58 feet (17.68 m.) in length for each strip green of the golf training facility. An eighteen strip green golf practice facility comprised of three rows of six strip greens would require roughly 180 by 200 feet (54.8 by 60.9 m.) total area.

In addition to natural turf, artificial turf may be used for an indoor golf practice facility or an outdoor facility designed to handle heavy use. This artificial turf must be of the highest quality to duplicate the actual chipping and putting conditions found on a typical golf course. Towards that end, only artificial putting surfaces with a length of grass equal to that which is found on a typical golf course may be used in the golf training facility. It will be appreciated that the goal of this golf training facility is to duplicate the conditions found on a typical golf course so that a golf trainee's time is well spent.

It should also be appreciated that the foregoing golf training facility may be readily incorporated into and realized through software, appropriate physical computer controls such as a mouse, joy stick or golf club with appropriate triaxial motion sensors and appropriate visual output means such as a two dimensional screen or three-dimensional (virtual reality) headset so that all of the features, training and teaching benefits of the present invention may be enjoyed and utilized virtually rather than actually.

The foregoing disclosure is the best mode devised by the inventor for practicing this invention. It is apparent, however, that a golf training facility incorporating modifications and variations will be obvious to one skilled in the art of golf training facilities. Inasmuch as the foregoing disclosure is intended to enable one skilled in the pertinent art to practice the instant invention, it should not be construed to be limited thereby, but should be construed to include such obvious variations and be limited only by the spirit and scope of the following claims.

I claim:

1. A golf putting training facility comprising, in combination:

a plurality of strip greens each including, a planar putting surface providing a combination of realistic inclination and surface conditions to provide a progressive degree of difficulty, at least one tee area, at least one hole, and said plurality of strip greens having at least one strip green with right to left downhill inclination; at least one strip green with left to right downhill inclination; a least one strip green with longitudinal uphill slope;

at least one strip green with longitudinal uphill and transverse left to right downhill slope;

at least one strip green with longitudinal uphill and transverse right to left downhill slope;

at least one strip green with longitudinal downhill slope;

at least one strip green with longitudinal downhill and transverse left to right downhill slope at least one strip green with longitudinal downhill and transverse right to left downhill slope, and means for determining a random tee position comprising a grid of lettered and numbered tee areas located on said putting surface and means for generating random letters and numbers corresponding to the letter and number of tee areas on said putting surface including a first die having designations between one and six, a second die having letters from A to F and a third die having faces of two distinct types having equal probability.

2. The golf training facility of claim 1 wherein said planar putting surface of two or more strip greens uses a different type or length of grass.

3. The golf training facility of claim 1 wherein said planar putting surface is natural grass.

4. The golf training facility of claim 1 wherein said planar putting surface is artificial turf.

5. The golf training facility of claim 1 further including at least one strip green having a planar putting surface that defines two parallel tiers and an inclined plane therebetween.

6. The golf training facility of claim 1 wherein each strip green further includes measuring scales.

7. The golf training facility of claim 1 wherein said plurality of strip greens are arranged in alternating directions to minimize walking distance between consecutive holes and tee areas to minimize the total land required.

8. The golf training facility of claim 1 wherein said structured order comprises at least eighteen strip greens.

9. A golf training facility comprising, in combination:

a plurality of strip greens each including, a planar putting surface providing a combination of realistic inclination and surface conditions to provide a progressive degree of difficulty, at least one tee area, at least one hole, said plurality of strip greens having at least one strip green with right to left downhill inclination; at least one strip green with left to right downhill inclination; a least one strip green with an uphill slope; at least one strip green with a downhill slope, and means for determining a random tee position comprising a grid of lettered and numbered tee areas located on said putting surface and means for generating random letters and numbers corresponding to the letter and number of tee areas on said putting surface including a first die having designations between one and six, a second die having letters from A to F and a third die having faces of two distinct types having equal probability.

10. The golf training facility of claim 9 wherein said planar putting surface of two or more strip greens uses a different type or length of grass.

11. The golf training facility of claim 9 wherein said planar putting surface is natural grass.

12. The golf training facility of claim 9 wherein said planar putting surface is artificial turf.

13. The golf training facility of claim 9 wherein at least one strip green has a planar putting surface that defines two parallel tiers and an inclined plane therebetween.

14. The golf training facility of claim 9 wherein each strip green further includes measuring scales.

15. The golf training facility of claim 9 wherein said plurality of strip greens are arranged in alternating directions to minimize walking distance between consecutive holes and tee areas to minimize the total land required.

16. The golf training facility of claim 9 wherein said structured order comprises at least eighteen strip greens.

* * * * *